US008141312B1

(12) United States Patent
Koble et al.

(10) Patent No.: US 8,141,312 B1
(45) Date of Patent: Mar. 27, 2012

(54) BATTEN FOR TILE ROOFS WITH STANDOFF CLIP

(76) Inventors: Danny L. Koble, Phoenix, AZ (US); Robert L. Koble, Jr., Camp Verde, AZ (US)

( * ) Notice: Subject to any disclaimer, the term of this patent is extended or adjusted under 35 U.S.C. 154(b) by 0 days.

(21) Appl. No.: 12/462,379

(22) Filed: Aug. 3, 2009

(51) Int. Cl.
*E04D 1/34* (2006.01)

(52) U.S. Cl. ..... 52/551; 52/448

(58) Field of Classification Search ..... 52/712, 52/839, 551, 302.1, 549, 302.6, 478, 715
See application file for complete search history.

(56) References Cited

U.S. PATENT DOCUMENTS 1,600,667 A * 9/1926 Fischer ..... 52/418
3,004,483 A * 10/1961 Prager et al. ..... 454/275
6,266,937 B1 * 7/2001 Watanabe ..... 52/489.2
6,536,171 B1 * 3/2003 Vandewater ..... 52/302.1
7,386,962 B2 * 6/2008 Estes et al. ..... 52/553
7,559,181 B2 * 7/2009 Estes et al. ..... 52/741.1
2003/0126824 A1 * 7/2003 Jensen ..... 52/715
2007/0033893 A1 * 2/2007 Voegele, Jr. ..... 52/466
2007/0113508 A1 * 5/2007 Hay et al. ..... 52/551
2009/0266017 A1 * 10/2009 Estes et al. ..... 52/302.1
2009/0301018 A1 * 12/2009 Voegele, Jr. ..... 52/466

* cited by examiner

*Primary Examiner* — Branon Painter
(74) *Attorney, Agent, or Firm* — H. Gordon Shields

(57) ABSTRACT

A wooden strip and a plurality of metal clips comprise or define a batten for securing tiles to a roof. Each clip includes a generally flat bottom and a pair of upwardly extending arms. Each arm includes an outwardly extending flange. Each flange includes at least a single barb extending upwardly for securing the clip to the wooden strip. The barbs are punched out of the flanges and extend into the bottom of the wooden strip to secure the clips to the wooden strip. The bottoms of the clips are flat to be disposed on the roof, with the arms supporting the wooden strip off the roof.

7 Claims, 2 Drawing Sheets

BATTEN FOR TILE ROOFS WITH STANDOFF CLIP

BACKGROUND OF THE INVENTION

1. Field of the Invention

This invention pertains to battens for tile roofs and, more particularly, to a wooden batten supported on the roof by a standoff clip.

2. Description of the Prior Art

Prior art battens are generally of two types, a pair of battens including a vertical batten and a horizontal batten on the vertical batten to raise the horizontal batten off the roof, and a horizontal batten with support pads or disks to raise the horizontal batten off the roof and to allow water to flow downwardly. The support pads or disks may be plastic or wood.

SUMMARY OF THE INVENTION

The invention described and claimed herein comprises batten including a wooden strip and a standoff clip for lifting the wooden strip off the roof. The clip is secured to the wooden strip by integral barbs and the batten is secured to the roof by appropriate fasteners, such as nails, screws, and staples. The top of the wooden strip is appropriately marked to indicate to a roofer where to insert a fastener to the batten so as to secure the wooden strip through the clip to the roof. The clip includes a generally flat bottom and a pair of upwardly extending arms which provide the desired standoff height for the wooden strip. Flanges extend outwardly from the arms and integral barbs extend upwardly from the flanges for securing the clip to the wooden strip.

Among the objects of the present invention are the following:

To provide a new and useful batten for securing tiles to a roof;

To provide a new and useful wooden batten for securing tiles to a roof;

To provide a new and useful batten having a plurality of clips secured to the bottom of a wooden strip for supporting the wooden strip a predetermined distance above a roof;

To provide a generally U-shaped standoff clip secured to a wooden strip; and

To provide a new and useful U-shaped clip having a pair of vertical arms extending upwardly generally perpendicular to and from a generally flat bottom and outwardly extending flanges having barbs for securing the clip to a wooden strip.

DESCRIPTION OF THE PREFERRED EMBODIMENT

Figure 1:
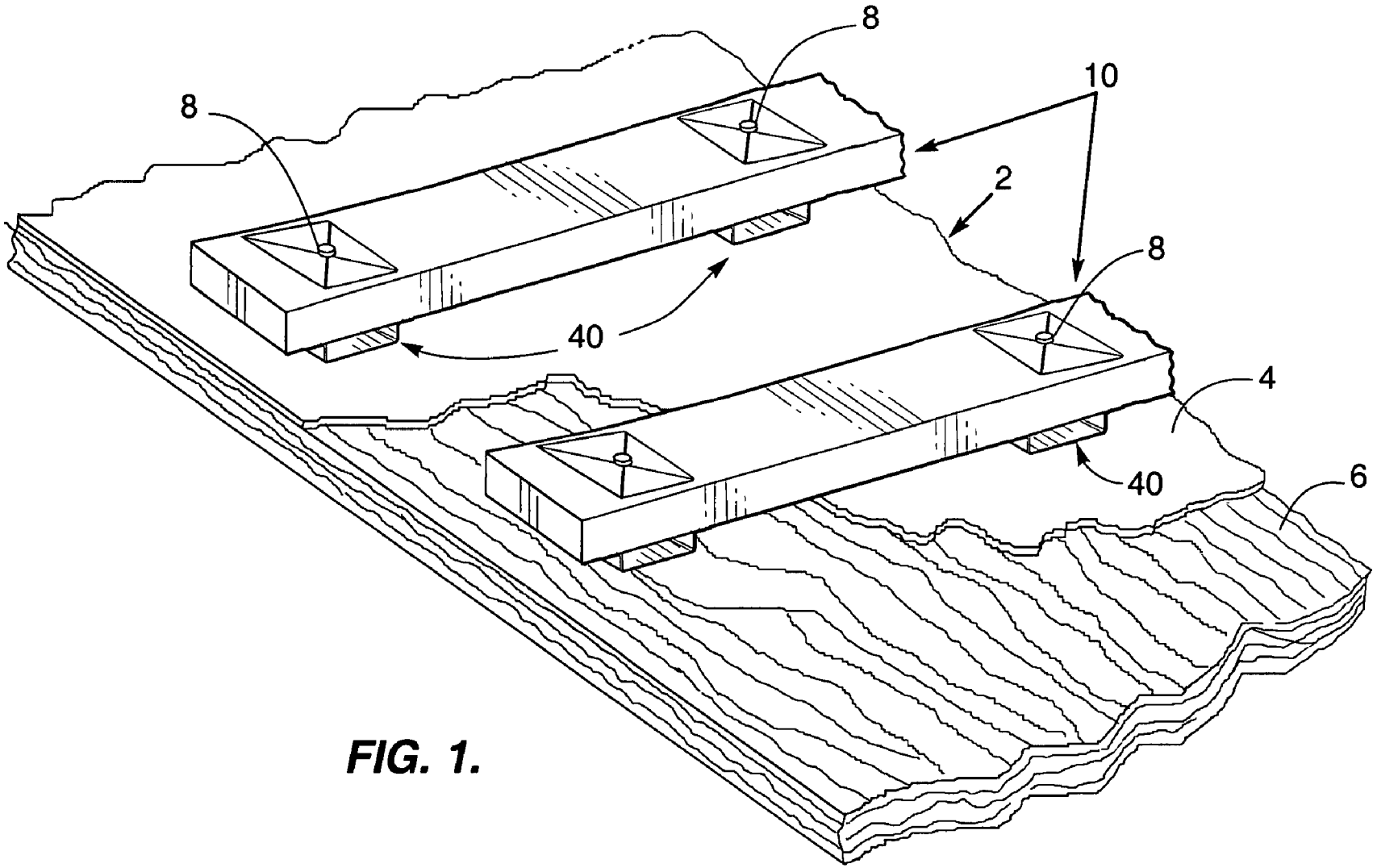
FIG. 1 is a fragmentary perspective view of part of a roof showing a portion of a batten of the present invention on the roof.
Figure 2:
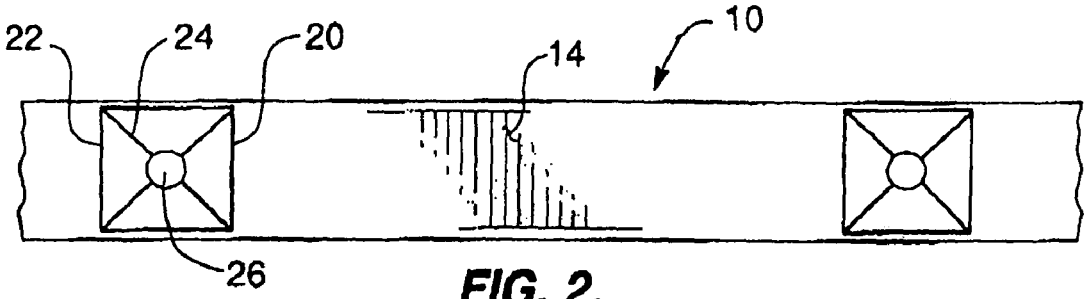
FIG. 2 is a top view of the batten of FIG. 1.
Figure 3:
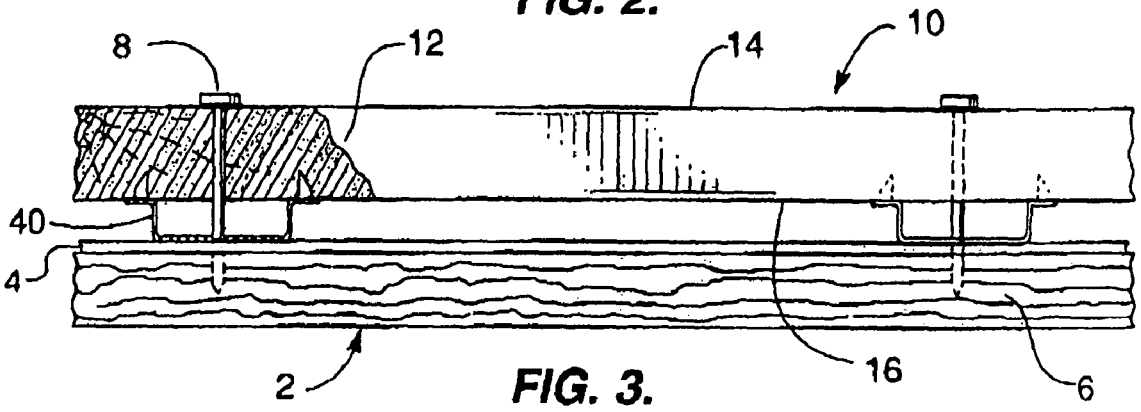
FIG. 3 is a side view in partial section of a portion of the elements shown in FIG. 1.
Figure 4:
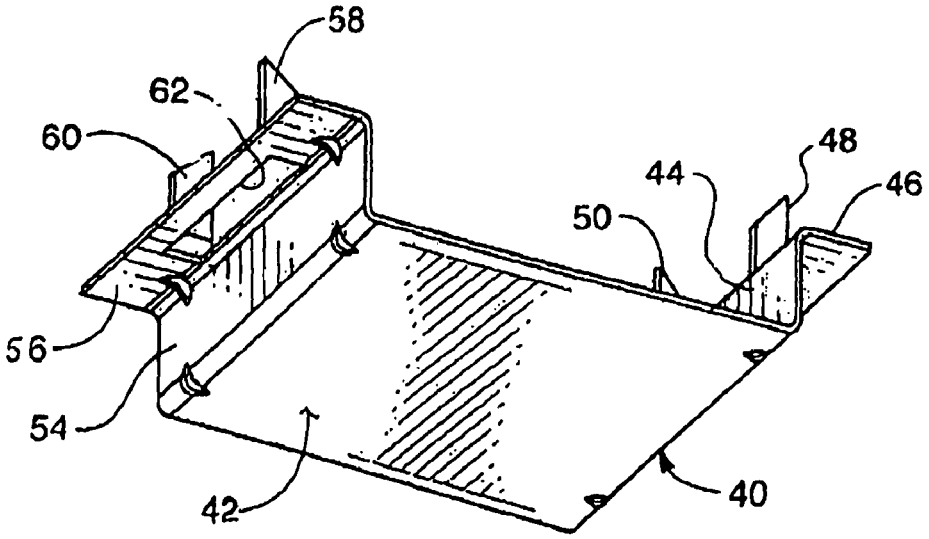
FIG. 4 is a perspective view of a standoff clip.

FIG. 1 is a fragmentary perspective view of a roof 2 having a sheathing layer 4 on a roof deck 6, and a pair of roof battens 10 disposed on and secured to the roof 2. FIG. 2 is a top view of a portion of the batten 10. FIG. 3 is a view in partial section of a portion of the roof 2 and the batten 10. FIG. 4 is a perspective view of a standoff clip 40. For the following discussion, reference may be made to all four of the drawing figures.

The roof battens 10 are spaced apart on the roof 2 as desired for supporting tiles. The battens 10 are preferably strips of wood 12 and are supported off the roof 2, or spaced above the roof 2, by a plurality of spaced apart standoff clips 40. The standoff clips 40 are generally U-shaped and made of metal by a stamping process.

The strips of wood 12 of the battens 10 are typically about one and a half inches wide and they may typically be about four or eight feet in length. The clips 40 are spaced about one foot apart on the wooden strips 12. As shown best in FIG. 3, the wooden strips 12 have a top surface 14 and a bottom surface 16. The clips 40 are appropriately secured to the bottom surface 16 of the wooden strips 12. The clips 40 are sized to have substantially the same width as the wooden strips 12, as indicated above.

As shown in FIGS. 1 and 2, the top surface 14 of the wooden strips 12 are marked for convenience by a pair of marker lines 20 and 22 which outline the arms of the clips 40, as will be discussed below. Between the marker lines 20 and 22 are a pair of crossing marker lines 24 which comprise an X configuration. The center spot of the X configuration is indicated by reference numeral 26 and indicates to a roofer the center of a clip 40 which is secured to the bottom 16 of the wooden strip 12.

The marker lines 20 and 22 and the center spot 26 comprise indicia for the convenience of a roofer. The center 26 indicates to a roofer the center of the clip 40. In FIG. 1, heads of nails 8 are shown securing the battens 10 to the roof 2. In FIG. 3, two nails 8 are shown securing the batten 10 to the roof 2.

Clip 40 is best shown in FIG. 4, which comprises a lower perspective view of the clip. The clip 40 is also shown in partial section in FIG. 3 secured to the wooden strip 12. Attention is directed primarily to those figures for the following discussion.

The clip 40 is generally U-shaped with a generally flat central bottom section 42. The bottom section 42 is disposed on the roof 2 as shown in FIG. 1. Extending upwardly from the bottom 42 are a pair of vertically extending arms 44 and 54. The arms 44 and 54 define the ends of the central bottom 42 of the clip 40. The arms 44 and 54 are generally perpendicular to the bottom 42.

Extending outwardly from the upper portion of the arms 44 and 54 are flanges 46 and 56, respectively. The flanges 46 and 56 are generally parallel to the bottom 42. The flanges 46 and 56 are disposed against the bottom 16 of the wooden strip 12.

Extending upwardly from the flange 46 are integral fastener barbs 48 and 50, and extending upwardly from the flange 56 are integral fastener barbs 58 and 60. The barbs 48, 50 and 58, 60 are appropriately punched from their respective flanges 46 and 56. This may be understood best from FIG. 4. An opening 62 is shown in the flange 56. The barbs 58 and 60 were punched from the flange 56, resulting in the opening 62.

The purpose of the barbs 48, 50 and 58, 60 is to secure the clip 40 to the bottom 16 of the wooden strip 12. This is best shown in FIG. 3. In FIG. 1, two assembled battens 10 are shown in FIG. 1 secured to the roof 2 with the strips 12 supported above the roof by the clips 40.

From FIG. 3 it is obvious that the wooden strip 12 is disposed above the roof 2 and is not in contact with the roof. Water drains beneath the strip 12 and through the clip 40, and the clip 40 also allows air to flow beneath the strip 12, thus ventilating the roof beneath the tiles (not shown). Moreover, dust, debris, etc., flows beneath the battens 10 and downwardly off the roof 2. With no direct contact between the roof 2 and the wooden strip 12, there will be no rotting, etc., of the wooden strip.

There is minimum cross sectional restriction between the clip 40 and the roof 2, thereby minimizing any obstruction or blockage to the flow of air and water and maximizing water and air flow. Such flows are virtually unimpeded by the narrow or low profile of the bottom 42 and arms 44 and 54 of each clip 40. Thus, rot is substantially eliminated, thereby prolonging the life of the batten 10 and the roof 2, and at the same time allowing virtually unimpeded air flow to keep the roof dry and to facilitate the drying of the roof after a rain and to help keep the roof cool by allowing hot air to rise and flow away from the roof. Again, the roof is the beneficiary of the batten 10.

The width of each clip 40 is substantially the same as the width of a wooden strip 12, as has been stated. With the top or upper surface 14 of each wooden strip 12 marked in alignment with each clip 40, a roofer is able to quickly and efficiently secure a batten 10 to a roof 2 through the bottom 42 of each clip 40.

Two barbs are shown extending upwardly from each flange, but it will be understood that each flange may have at least a single barb. While a single barb on each flange may be sufficient to secure a clip 40 to a wooden strip, two barbs are preferable. However, there may be more than two barbs also extending upwardly from each flange, if desired.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. A batten system for securing tiles to a roof comprising in combination:

a wooden strip having a top surface and a bottom surface;

a plurality of generally U-shaped clips secured to the bottom surface of the strip of wood, each of which clips include a generally flat bottom to be disposed against the roof and having a first end and a second end, a first arm extending upwardly from the first end, a first flange extending outwardly from the first arm generally parallel to the flat bottom, a second arm extending upwardly from the second end, a second flange extending outwardly from the second end generally parallel to the flat bottom; and means for securing the first and second flanges to the bottom of the wooden strip.

2. The batten system of claim 1 which the means for securing the first and second flanges to the bottom of the wooden strip comprise at least a single barb extending upwardly from each flange and into the wooden strip.

3. The batten system of claim 2 in which the barbs are integral with the flanges.

4. The batten system of claim 1 in which the means for securing the first and second flanges comprises barbs punched from the flanges and extending into the wooden strip.

5. The batten system of claim 1 which further includes indicia on the top of the wooden strip aligned with each clip to indicate locations for nailing the batten to the roof through each clip.

6. The batten system of claim 1 in which the wooden strip has a width and the clip has a width which is substantially the same as the width of the wooden strip.

7. The batten system of claim 1 in which the first and second arms of the clips are generally perpendicular to the generally flat bottom.

* * * * *